US009155406B1

(12) United States Patent
Whiteside et al.

(10) Patent No.: US 9,155,406 B1
(45) Date of Patent: Oct. 13, 2015

(54) CONVERSION LIFTING PLATFORM

(71) Applicant: NCR Corporation, Duluth, GA (US)

(72) Inventors: William Brian Whiteside, Ball Park, GA (US); Josh Minter, Atlanta, GA (US)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 14/633,968

(22) Filed: Feb. 27, 2015

(51) Int. Cl.
*G06K 15/00* (2006.01)
*A47F 9/04* (2006.01)
*A47F 10/02* (2006.01)

(52) U.S. Cl.
CPC .. *A47F 9/04* (2013.01); *A47F 10/02* (2013.01)

(58) Field of Classification Search
USPC ..... 235/375, 379, 383
See application file for complete search history.

(56) References Cited

U.S. PATENT DOCUMENTS

| | | | | |
|---|---|---|---|---|
| 6,715,677 | B1 * | 4/2004 | Nugent, Jr. | 235/383 |
| 2003/0115103 | A1 * | 6/2003 | Mason | 705/16 |
| 2003/0205177 | A1 * | 11/2003 | Kerber | 108/42 |
| 2004/0050626 | A1 * | 3/2004 | Lantz et al. | 186/66 |
| 2007/0138269 | A1 * | 6/2007 | Baitz et al. | 235/383 |
| 2009/0292391 | A1 * | 11/2009 | Yoshizawa | 700/219 |
| 2014/0360816 | A1 * | 12/2014 | Kesterson et al. | 186/67 |

* cited by examiner

*Primary Examiner* — Christle I Marshall
(74) *Attorney, Agent, or Firm* — Schwegman Lundberg & Woessner

(57) ABSTRACT

A device includes a housing, a rotatable platform, and a lift assembly supported by the housing and coupled to lift the rotatable platform above a working surface of the housing, the rotatable platform configured to support a checkout module and rotate the checkout module between a self-checkout position and an assisted checkout position.

20 Claims, 7 Drawing Sheets

CONVERSION LIFTING PLATFORM

BACKGROUND

Consumers are increasingly using kiosks to conduct business with enterprises. The kiosks come in a variety of sizes and are used for a variety of purposes. Some kiosks are drive through, such as fast food establishments, pharmacies, banks, and the like. Other kiosks are stationary located in gas stations, grocery stores, department stores, and the like.

Store kiosks were originally created to alleviate the need for excessive store personnel to check out the customers from stores. For the most part this worked and stores reduced the number of costly cashiers employed by the stores. However, more often than not, the bottleneck in stores may be at self-checkout kiosks. While customers attempt to use them properly, store personnel are often needed to assist the customers in using them. Meanwhile, full service checkout lanes are diminishing from the stores in greater numbers.

In short, self-checkout kiosks are the victim of their own success because the popularity has been so well received the traditional model and the self-checkout kiosks may become a bottleneck in stores during heavy customer demand periods.

SUMMARY

A device includes a housing, a rotatable platform, and a lift assembly supported by the housing and coupled to lift the rotatable platform above a working surface of the housing, the rotatable platform configured to support a checkout module and rotate the checkout module between a self-checkout position and an assisted checkout position.

A system includes a housing, a checkout module having a product identifier, a rotatable platform configured to support and rotate the checkout module, and a lift assembly supported by the housing and coupled to lift the rotatable platform above the housing such that the checkout module is rotatable between a self-checkout position and an assisted checkout position when lowered back to the housing.

A method includes receiving force to rotate a gear to raise a platform containing a checkout module above a surface of a housing, receiving force to rotate the platform to place the checkout module into a self-checkout orientation or an assisted checkout orientation, and receiving force to lower the platform containing the checkout module such that the module and housing operate in a self-checkout mode or an assisted checkout mode.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

Figure 1:
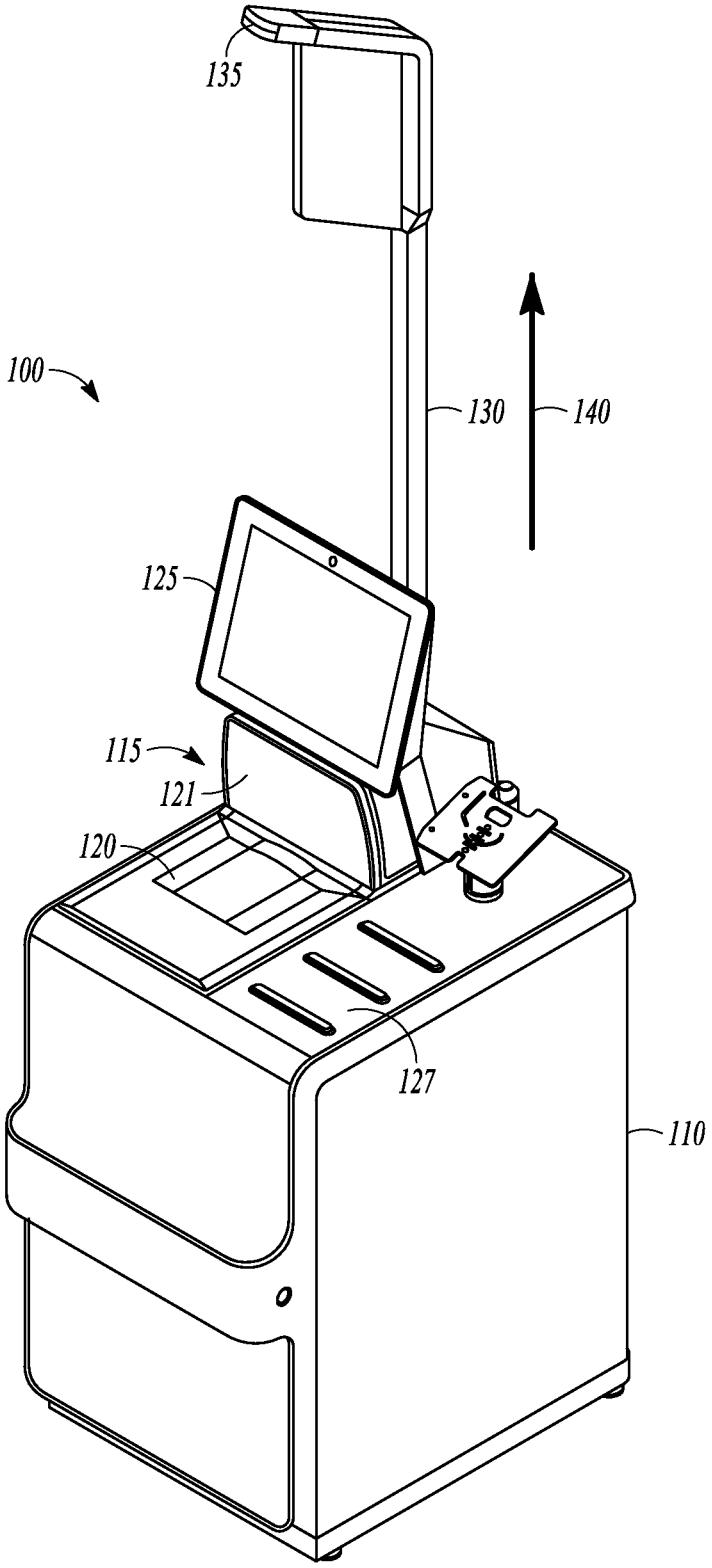
FIG. 1 is a block perspective diagram of a system incorporating a conversion lifting platform according to an example embodiment.

FIG. 1 is a block perspective diagram of a system 100 that includes a housing 110 supporting a checkout module indicated generally at 115. Housing 110 may have a rack like structure and may contain circuitry to provide power, processing, circuitry, card reading and other functions. In various embodiments, the checkout module includes a product identifier, such as one or more product identifiers, such as RF readers or barcode scanners 120, 121, and a display device 125, which may be a touchscreen type of display device for accepting user input. Scanner 120 is shown as parallel to a working surface 127 of the housing 110 to facilitate scanning of products to be purchased. The working surface may also be referred to as a top surface. The module 115 may alternatively include customer card readers for completing transactions as opposed to including card readers in a rack in housing 110. A marker device 130 may be used to provide indicators to customers, such as via a light 135 having a color representative of a status of a lane that the system is servicing.

System 100 may be used in two different modes. A customer self-service mode wherein the customer scans products the customer is purchasing, or in an assisted mode, where a cashier scans the customer's products and performs other checkout functions. The modes may be changed by the cashier by lifting the module 115 as indicated by arrow 140, and rotating it 180 degrees such that the scanners and display are facing opposite the position shown in FIG. 1. Such a changing enables the flow of customer traffic to remain the same in both modes, but facilitates changing the party handling the scanning. Generally, cashiers are much more proficient at scanning products, having practiced doing so many more hours than an average customer. Changing the mode of operation thus provides a store the option of configuring systems in either mode to facilitate efficient customer flow and reduce bottlenecks which may be caused by customer self-checkout during busy periods.

Note that the module 115 may weigh more than is conveniently lifted by cashiers and other store personnel. Typical modules today weigh nearly 40 Kg. Prior methods of reversing modes involved sliding the module out of the rack and using separate equipment to rotate it and slide it back into the rack.

Figure 2:
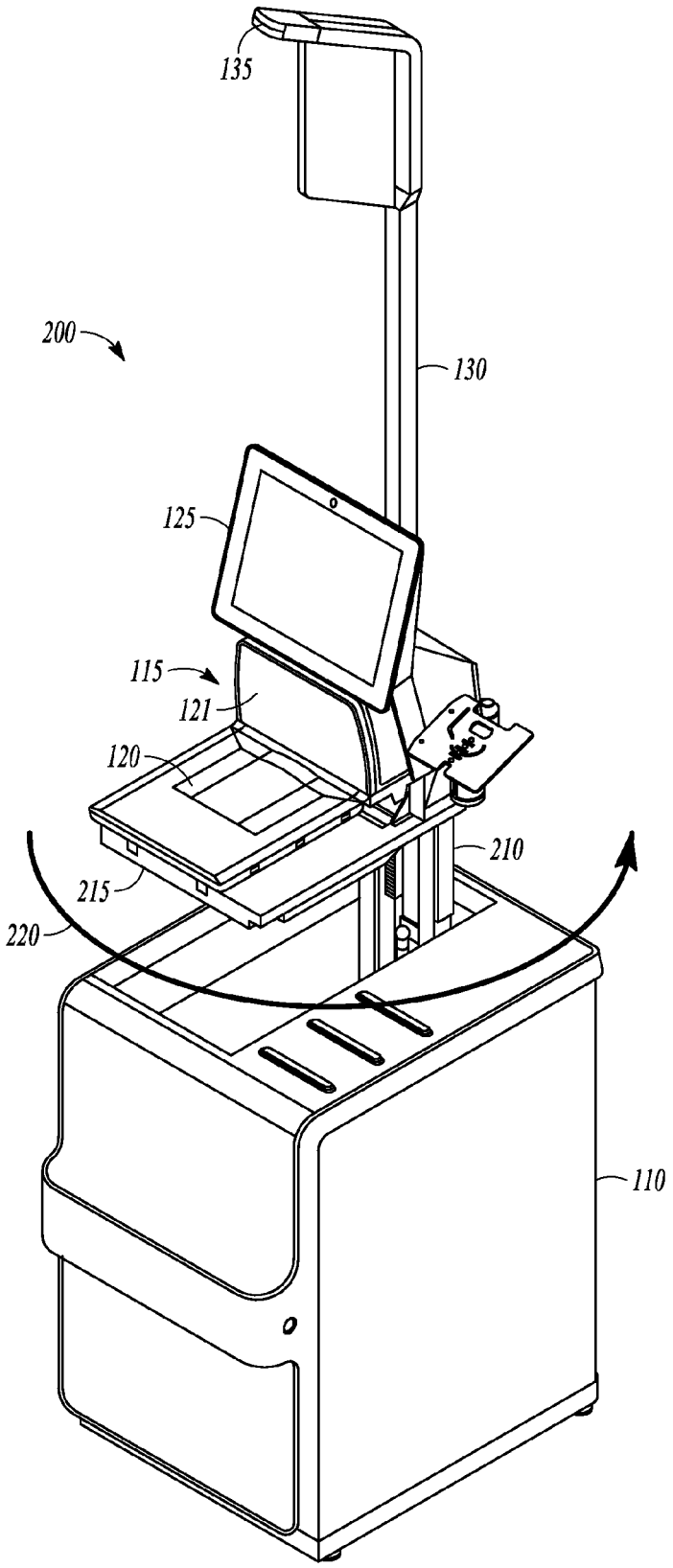
FIG. 2 is a block perspective diagram of the system of FIG. 1 illustrating a module lifted above a top surface according to an example embodiment.

FIG. 2 is a block perspective diagram of system 100 illustrating the module 115 lifted above the top surface 127 of the housing 110 as indicating generally at 200. The lift travel may be about 7 inches (177.8 mm) in one embodiment, but may vary depending on the size of the module to be reconfigured. A lifting arm 210 is coupled to a rotatable platform 215, both of which are shown in further detail below. Once the module is lifted, the platform 215 supports the module above the surface 127 of the housing and allows rotation as indicated by arrow 220.

Figure 3:
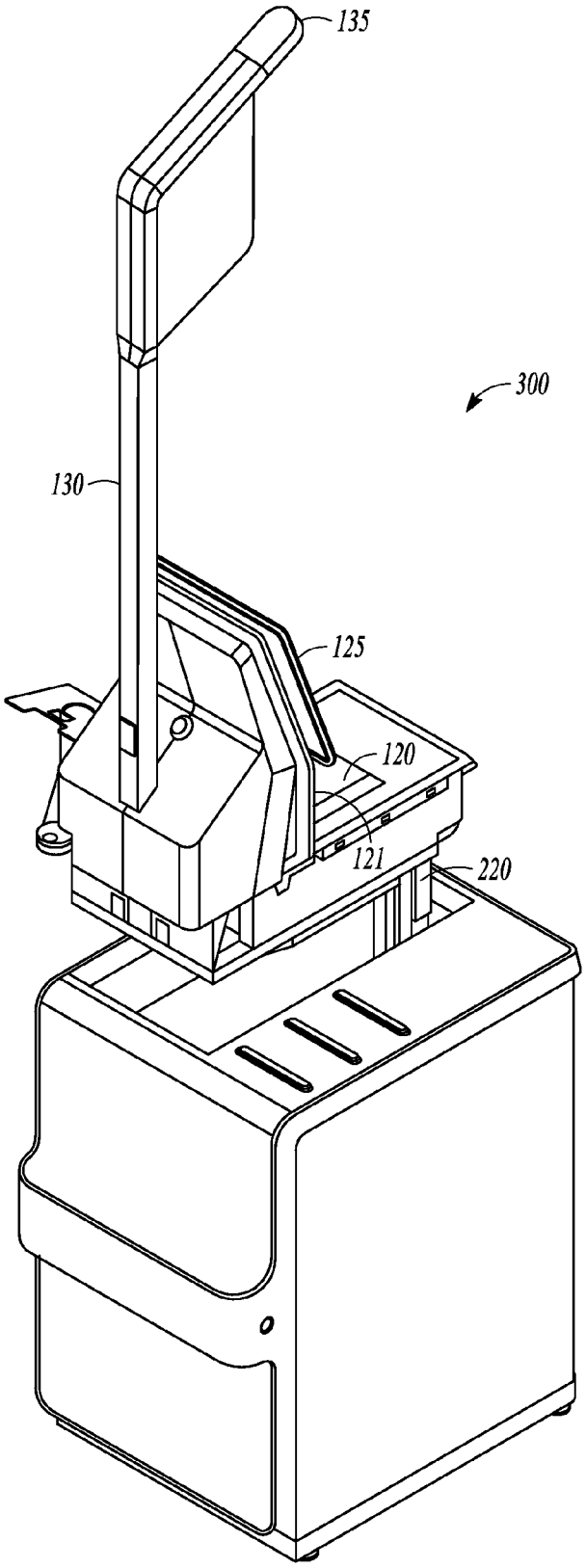
FIG. 3 is a block perspective diagram of the system of FIG. 1 illustrating a module lifted above a top surface and rotated according to an example embodiment.
Figure 4:
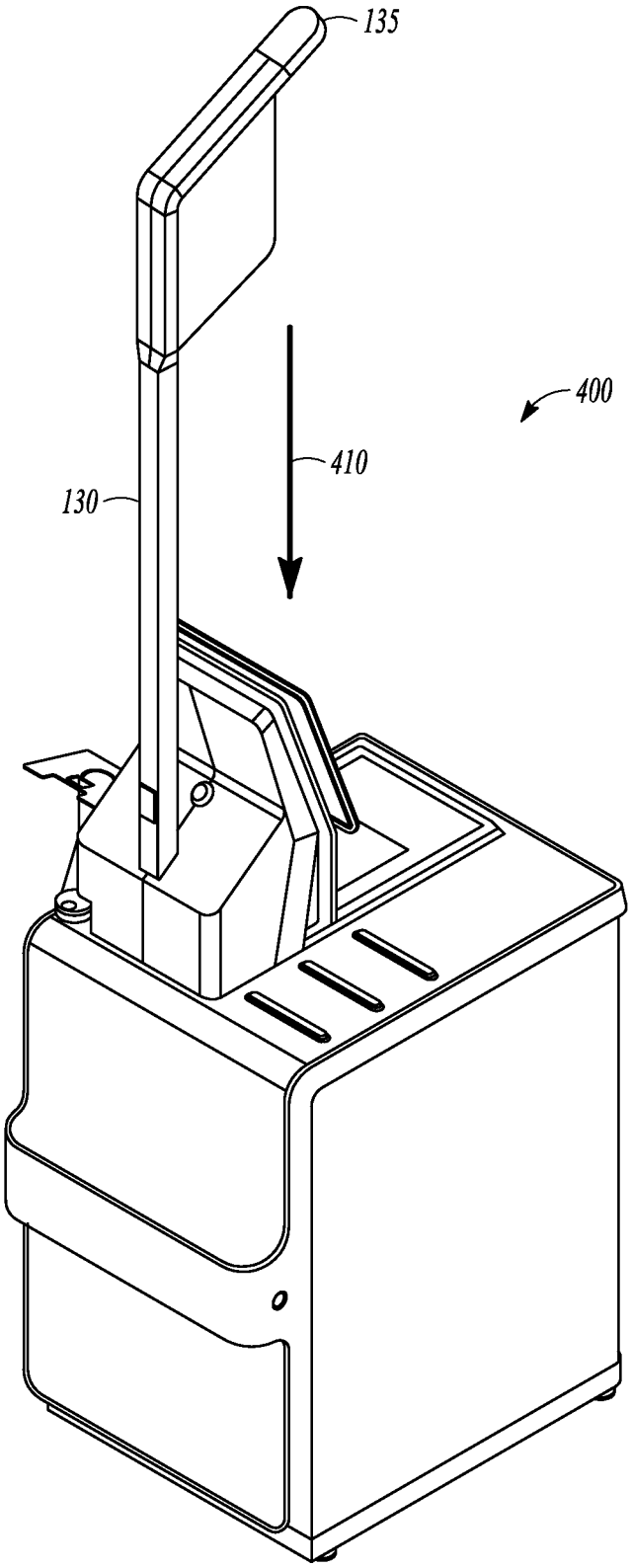
FIG. 4 is a block perspective diagram of the system of FIG. 1 illustrating a module in a converted position according to an example embodiment.

Once rotated, the module is now in a position indicated at 300 in FIG. 3, facing 180 degrees from the original position. The lifting arm 210 is then used to lower the module back to a position such that the scanner 120 is again flush with the top surface 127 of the housing 110 as illustrated at 400 in FIG. 4. An arrow 410 shows the direction corresponding to lowering the module. FIGS. 1 and 4 thus show the system 100 in two different modes of operation, a customer self-checkout mode indicated at 100 or 400, and in a customer assisted mode indicated at 400 or 100 respectively. In some embodiments, the direction of the module combined with designed customer traffic patterns in a store may define which mode the system is in.

Figure 5:
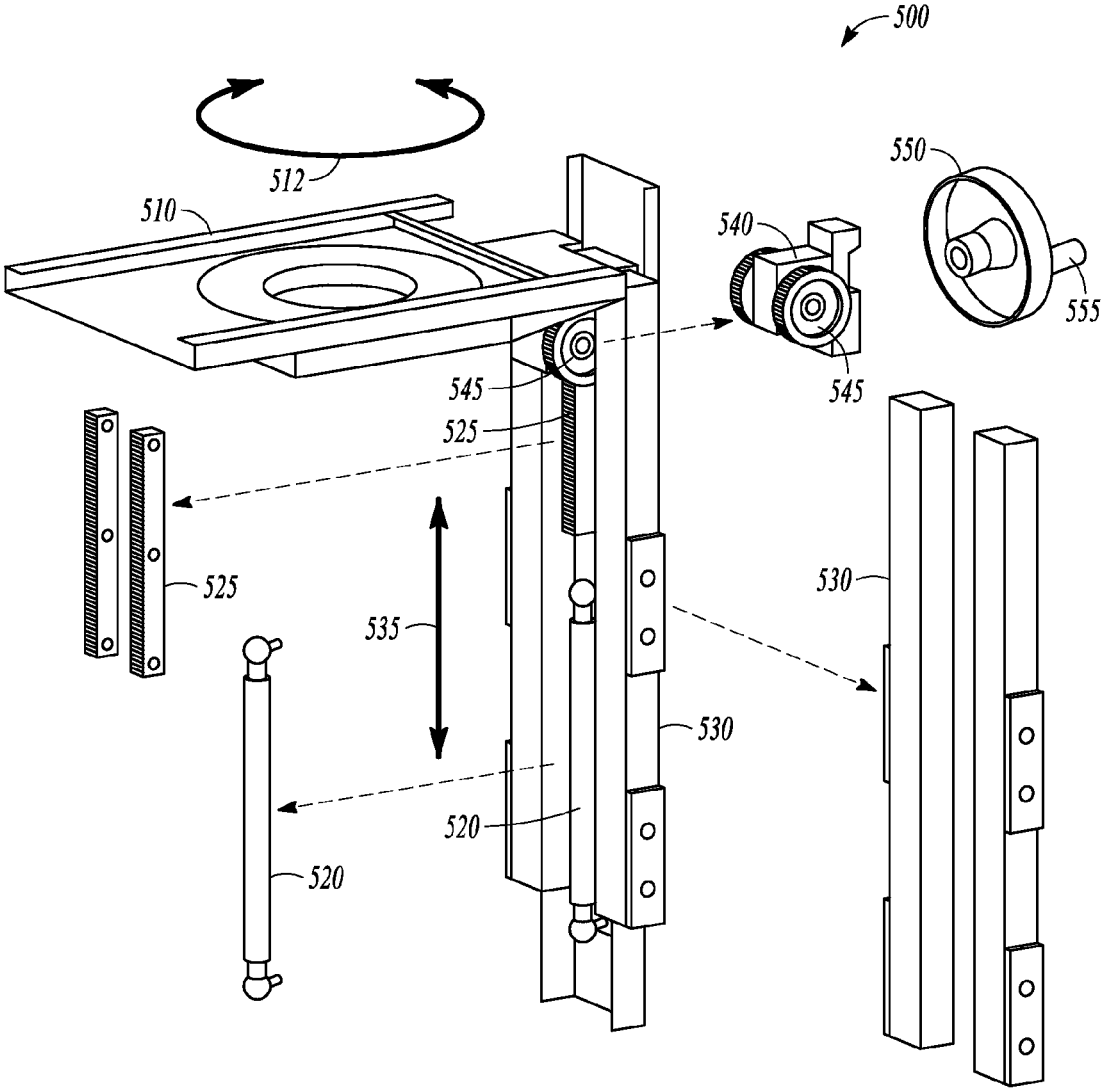
FIG. 5 is pseudo exploded perspective block diagram view of a lift assembly according to an example embodiment.

FIG. 5 is a pseudo exploded perspective block diagram view of a lift assembly 500, also referred to as a lifting assembly. The lifting assembly 500 is shown fully assembled, but selected parts are duplicated and separately illustrated to more clearly illustrate the assembled lifting assembly 500.

In one embodiment, the lifting mechanism 500 includes a rotatable platform 510. The lifting mechanism 500 is supported by the housing and coupled to lift the rotatable platform 510 above the housing. The rotatable platform 510 configured to support a checkout module and rotate the checkout module between a self-checkout position and an assisted checkout position as illustrated by arrow 512. A bearing 515 may be used to provide for rotation of the rotatable platform and the platform and bearing 515 are structurally formed to support typical module weights and securely hold the module during rotation.

In one embodiment, a spring 520 is coupled to the lift assembly to act as a counter balance to aid in lifting the rotatable platform with self-checkout module. The spring 520 may be a gas spring, such as one rated at 80 lbs in one embodiment, corresponding to slightly less than the weight of the module and lift assembly combined.

The lift assembly 500 may also include at least one gear rack 525 (two shown) coupled to an upright support arm 530. The upright support arm may include C-shaped rails (PCB Linear CR30 Rail, 400 mm long, Part Number CR30R400 for example) with crown rollers mounted in linear rail slide blocks (4 blocks—PCB Linear CR30 Slide, Part Number CRSS30MCA for example) to provide a telescoping mount for the rotatable platform that is driven up and down by the gear racks 525. The direction of telescoping is illustrated by arrow 535.

A worm drive 540 supported by housing 110 may have one or more spur gears 545 to mesh with the gear rack 525. An example gear rack may have a height of 0.720 inches (18.300 mm), width of 0.750 inches (19.050 mm) and length of 8 inches (203.2 mm), with a 20 degree pressure angle, pitch 16 and may be formed of machinable carbon steel or other suitable material. In one example embodiment, the spur gears have 36 teeth, a 20 degree pressure angle, a 16 pitch, and are formed of machinable carbon steel or other suitable material. Various other gears having different numbers of teeth, angles and pitch may be used in further embodiments. Rotation of the worm drive, such as by a user utilizing a hand gear 550 coupled to the worm drive 540 is used to move the platform up and down, altogether providing an 18:1 ratio gear drive in one embodiment. Other ratios may be used in further embodiments such as may be desired based on ergonomic factors.

No lock is needed in some embodiments, as the platform may be configured to stop downward motion when flush with the top surface 127 of the housing 110, and the weight of the module will keep the module from lifting without force applied by a user to the worm drive. In one embodiment, the hand gear may include a handle 555 to rotate the hand gear.

Figure 6:
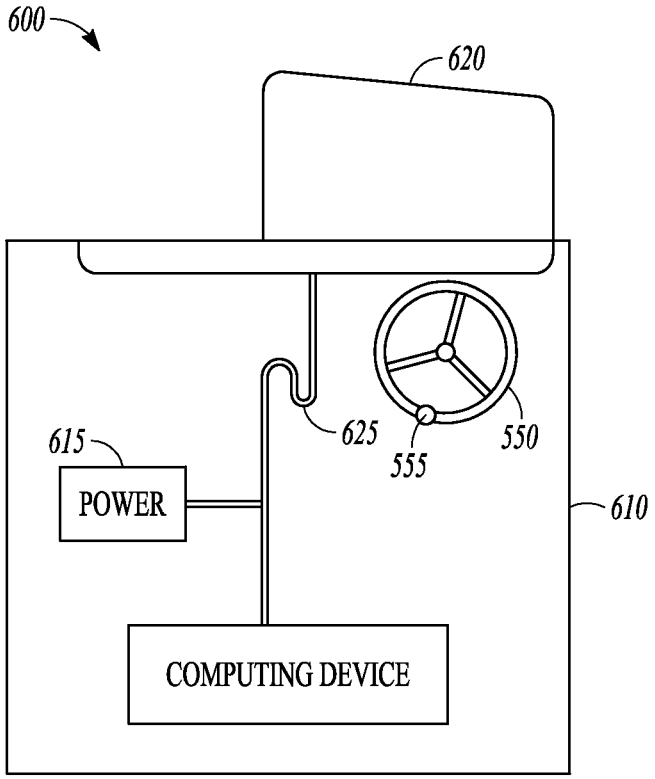
FIG. 6 is a block rear elevation representation of a system incorporating a conversion lifting platform according to an example embodiment.

FIG. 6 is a block rear elevation representation of the system at 600. System 600 includes a housing 610, which may include various electronics 615 for interfacing with a checkout module 620 via an electrical connector 625. In one embodiment, connector 625 is an electrical connector cable coupled between the checkout module 620 and the housing 610. The electrical connector cable 625 may contain sufficient slack to allow lifting and rotation of the checkout module 620 between the self-checkout position and the assisted checkout position. In some embodiments, rotation of the module 620 may be limited in one direction to 180 degrees by two sets of 90 degree circular slots in the lift and rotating platforms and a plate in between with studs and bushings in a specific arrangement. The combination of rotating platforms and plate act as a bearing mechanism for rotation. Ultra High Molecular Weight plastic may be used to overcome the friction instead of ball bearings or other type of bearing. A computing device 630 as described in further detail may also be included either in the module 620, housing 610, or both.

The functions or algorithms utilized to scan products, perform checkout transactions, and communicate with other computers such as remote servers, may be implemented in software or a combination of software and human implemented procedures in one embodiment. The software may consist of computer executable instructions stored on computer readable media or computer readable storage device such as one or more memory or other type of hardware based storage devices, either local or networked. Further, such functions correspond to modules, which are software, hardware, firmware or any combination thereof. Multiple functions may be performed in one or more modules as desired, and the embodiments described are merely examples. The software may be executed on a digital signal processor, ASIC, microprocessor, or other type of processor operating on a computer system, such as a personal computer, server or other computer system.

Figure 7:
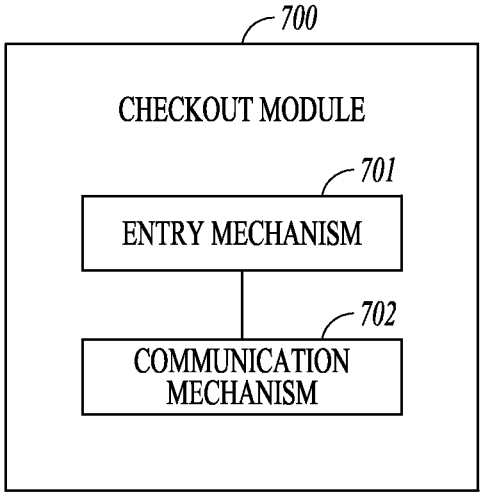
FIG. 7 is a simplified block diagram of a checkout module according to an example embodiment.

FIG. 7 is a simplified block diagram of a checkout module 700 according to an example embodiment. The scanner 700 includes one or more computing devices such as programmed processors that are specifically configured to perform processing associated with scanning products and obtaining payment information to perform customer checkout. The module 700 may include a variety of other hardware components, such as network adapters, memory, display screen, input mechanisms, and the like.

In one embodiment, the module 700 includes an entry mechanism 701 and a communication mechanism 702. Each of these and their interactions with one another will now be discussed in turn.

The entry mechanism 701 can include a digital camera, key input buttons, a track ball for selecting information on a screen of the scanner 700, a touch screen having information selected thereon, and/or a microphone integrated with voice recognition software for the customer to audibly communicate information.

The entry mechanism 701 is configured to be operated by a customer within a store to initiate a transaction in one mode, and by a cashier in another mode. The transaction is independent of any particular store-based checkout terminal. The entry mechanism 701 is also configured to record scan details for goods that the customer plans to purchase before concluding a transaction with the store.

The communication mechanism 702 is configured to communicate information from and to the scanner. The information can be communicated to other devices over a wireless network, such as the checkout terminal or a store-based enterprise server, and information can be communicated from the checkout terminal or server back to the scanner 700 via the communication mechanism 702.

In one embodiment, the communication mechanism 702 may be configured to communicate a transaction identifier for the transaction and the scan details to the remote server. In cases, where the identifier and scan details are communicated to the remote server, the remote server subsequently communicates with the module 700 to supply the transaction identifier and scan details at checkout by the customer.

One example computing device may include a processing unit, memory, removable storage, and non-removable storage. The computing device may be in different forms in different embodiments. Cloud-based storage that is accessible via a network, such as the Internet may also be used.

The computing device may operate in a networked environment using a communication connection to connect to one or more remote computers, such as database servers. The remote computer may include a personal computer (PC), server, router, network PC, a peer device or other common network node, or the like. The communication connection may include a Local Area Network (LAN), a Wide Area Network (WAN), cellular, WiFi, Bluetooth, or other networks.

Computer-readable instructions stored on a computer-readable medium are executable by the processing unit the computer device. A hard drive, CD-ROM, and RAM are some examples of articles including a non-transitory computer-readable medium such as a storage device. The terms computer-readable medium and storage device do not include carrier waves.

Figure 8:
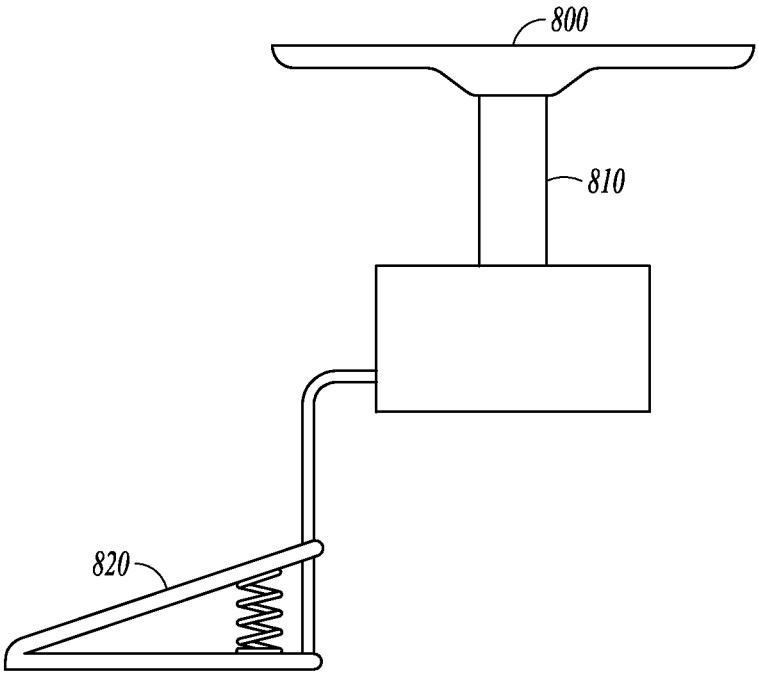
FIG. 8 is a block diagram of a rotatable platform that is vertically movable via a piston arrangement according to an example embodiment.
Figure 9:
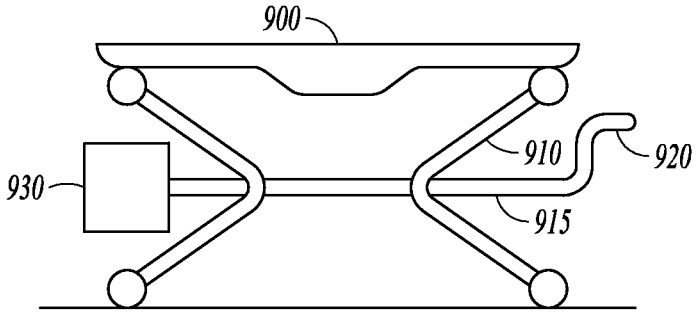
FIG. 9 is a block diagram of a rotatable platform that is vertically movable via a jack like structure according to an example embodiment.

In further embodiments, different lifting mechanisms may be employed that allow lifting of the rotatable platform sufficiently to convert the system 100 between modes. FIG. 8 is a block diagram of a rotatable platform 800 that is vertically movable via a piston arrangement 810 that may be operated by a foot pedal 820. FIG. 9 is a block diagram of a rotatable platform 900 that is vertically movable via a jack like structure operated 910 including a screw 916 operable by a handle 920 or motor 830. Various other lifting mechanisms may include hydraulic pistons, hinges, servo motors, linkages, pneumatic, hydraulic, block and tackle, linear actuators, drive wedges, magnetic levitation, scissor jack, belt drive, chain drive, cable operated caliper, lift lever, air bladder, winch, large screw drive, and other structures in further embodiments.

Examples

1. A device comprising:

a housing;

a rotatable platform;

a lift assembly supported by the housing and coupled to lift the rotatable platform above a working surface of the housing, the rotatable platform configured to support a checkout module and rotate the checkout module between a self-checkout position and an assisted checkout position.

2. The device of example 1 and further comprising a spring coupled to the lift assembly to act as a counter balance to aid in lifting the rotatable platform with self-checkout module.

3. The device of any of examples 1-2 wherein the lift assembly comprises a gear rack coupled to an upright support arm, which upright support arm is coupled to the rotatable platform.

4. The device of example 3 and further comprising a worm drive having a spur gear to mesh with the gear rack.

5. The device of example 4 wherein the gear rack comprises two gear racks and wherein the worm drive comprises two spur gears to mesh with respective gear racks.

6. The device of example 5 and further comprising a hand gear coupled to the worm drive to rotate the worm drive.

7. The device of example 6 wherein the hand gear comprises a handle to rotate the hand gear.

8. The device of any of examples 1-7 and further comprising a gas spring coupled to the lift assembly to act as a counter balance to aid in lifting the rotatable platform with self-checkout module.

9. A system comprising:

a housing;

a checkout module having a product identifier;

a rotatable platform configured to support and rotate the checkout module; and a lift assembly supported by the housing and coupled to lift the rotatable platform above the housing such that the checkout module is rotatable between a self-checkout position and an assisted checkout position when lowered back to the housing.

10. The system of example 9 and further comprising an electrical connector cable coupled between the checkout module and the housing, wherein the electrical connector cable contains sufficient slack to allow lifting and rotation of the module between the self-checkout position and the assisted checkout position.

11. The system of any of examples 9-10 wherein the rotatable platform permits rotation of the module in one direction from either position.

12. The system of any of examples 9-11 and further comprising a spring coupled to the lift assembly to act as a counter balance to aid in lifting the rotatable platform with self-checkout module.

13. The system of any of examples 9-12 wherein the lift assembly comprises a gear rack coupled to an upright support arm, which upright support arm is coupled to the rotatable platform.

14. The system of example 13 and further comprising a worm drive having a spur gear to mesh with the gear rack.

15. The system of example 14 wherein the gear rack comprises two gear racks and wherein the worm drive comprises two spur gears to mesh with respective gear racks.

16. The system of example 15 and further comprising a hand gear coupled to the worm drive to rotate the worm drive.

17. The system of example 16 wherein the hand gear comprises a handle to rotate the hand gear.

18. The system of any of examples 9-17 and further comprising a gas spring coupled to the lift assembly to act as a counter balance to aid in lifting the rotatable platform with self-checkout module.

19. The system of any of examples 9-18 wherein the product identifier comprises a scanner.

20. A method comprising:

receiving force to rotate a gear to raise a platform containing a checkout module above a surface of a housing;

receiving force to rotate the platform to place the checkout module into a self-checkout orientation or an assisted checkout orientation; and receiving force to lower the platform containing the checkout module such that the module and housing operate in a self-checkout mode or an assisted checkout mode.

Although a few embodiments have been described in detail above, other modifications are possible. For example, the logic flows depicted in the figures do not require the particular order shown, or sequential order, to achieve desirable results. Other steps may be provided, or steps may be eliminated, from the described flows, and other components may be added to, or removed from, the described systems. Other embodiments may be within the scope of the following claims.

The invention claimed is:

1. A device comprising:

a housing;

a rotatable platform;

a lift assembly supported by the housing and configured to lift the rotatable platform above a working surface of the housing, the rotatable platform configured to support a checkout module and rotate the checkout module between a self-checkout position and an assisted checkout position.

2. The device of claim 1 and further comprising a spring coupled to the lift assembly to act as a counter balance to aid in lifting the rotatable platform with self-checkout module.

3. The device of claim 1 wherein the lift assembly comprises a gear rack coupled to an upright support arm, which upright support arm is coupled to the rotatable platform.

4. The device of claim 3 and further comprising a worm drive having a spur gear to mesh with the gear rack.

5. The device of claim 4 wherein the gear rack comprises two gear racks and wherein the worm drive comprises two spur gears to mesh with respective gear racks.

6. The device of claim 5 and further comprising a hand gear coupled to the worm drive to rotate the worm drive.

7. The device of claim 6 wherein the hand gear comprises a handle to rotate the hand gear.

8. The device of claim 1 and further comprising a gas spring coupled to the lift assembly to act as a counter balance to aid in lifting the rotatable platform with self-checkout module.

9. A system comprising:

a housing;

a checkout module having a product identifier;

a rotatable platform configured to support and rotate the checkout module; and a lift assembly supported by the housing and configured to lift the rotatable platform above the housing such that the checkout module is rotatable between a self-checkout position and an assisted checkout position when lowered back to the housing.

10. The system of claim 9 and further comprising an electrical connector cable coupled between the checkout module and the housing, wherein the electrical connector cable contains sufficient slack to allow lifting and rotation of the module between the self-checkout position and the assisted checkout position.

11. The system of claim 9 wherein the rotatable platform permits rotation of the module in one direction from either position.

12. The system of claim 9 and further comprising a spring coupled to the lift assembly to act as a counter balance to aid in lifting the rotatable platform with self-checkout module.

13. The system of claim 9 wherein the lift assembly comprises a gear rack coupled to an upright support arm, which upright support arm is coupled to the rotatable platform.

14. The system of claim 13 and further comprising a worm drive having a spur gear to mesh with the gear rack.

15. The system of claim 14 wherein the gear rack comprises two gear racks and wherein the worm drive comprises two spur gears to mesh with respective gear racks.

16. The system of claim 15 and further comprising a hand gear coupled to the worm drive to rotate the worm drive.

17. The system of claim 16 wherein the hand gear comprises a handle to rotate the hand gear.

18. The system of claim 9 and further comprising a gas spring coupled to the lift assembly to act as a counter balance to aid in lifting the rotatable platform with self-checkout module.

19. The system of claim 9 wherein the product identifier comprises a scanner.

20. A method comprising:

receiving force to rotate a gear to raise a platform containing a checkout module above a surface of a housing;

receiving force to rotate the platform to place the checkout module into a self-checkout orientation or an assisted checkout orientation; and receiving force to lower the platform containing the checkout module such that the module and housing operate in a self-checkout mode or an assisted checkout mode.

* * * * *